US011548294B2

(12) United States Patent
Saiga et al.

(10) Patent No.: US 11,548,294 B2
(45) Date of Patent: Jan. 10, 2023

(54) METHOD OF PRINTING INCLUDING APPLYING A PROCESSING FLUID AND WHITE INK TO A SUBSTRATE AND DEVICE FOR SUCH PRINTING

(71) Applicants: Takuya Saiga, Kanagawa (JP); Sei Yamamoto, Tokyo (JP); Kazuhiko Umemura, Kanagawa (JP); Yuya Hirokawa, Kanagawa (JP); Hiroki Hagiwara, Kanagawa (JP)

(72) Inventors: Takuya Saiga, Kanagawa (JP); Sei Yamamoto, Tokyo (JP); Kazuhiko Umemura, Kanagawa (JP); Yuya Hirokawa, Kanagawa (JP); Hiroki Hagiwara, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/497,966

(22) Filed: Oct. 10, 2021

(65) Prior Publication Data

US 2022/0118774 A1 Apr. 21, 2022

(30) Foreign Application Priority Data

Oct. 20, 2020 (JP) ..... JP2020-176153
Jun. 4, 2021 (JP) ..... JP2021-094067

(51) Int. Cl.
*B41J 11/00* (2006.01)
*B41J 2/21* (2006.01)

(52) U.S. Cl.
CPC ..... *B41J 11/002* (2013.01); *B41J 2/2117* (2013.01)

(58) Field of Classification Search
CPC ..... B41J 11/002; B41J 2/2117; B41J 2/2114; B41J 11/0015; B41M 5/0017
See application file for complete search history.

(56) References Cited

U.S. PATENT DOCUMENTS

| | | | | |
|---|---|---|---|---|
| 10,259,965 | B2 * | 4/2019 | Nakagawa | C09D 123/0853 |
| 2014/0267520 | A1 | 9/2014 | Toda et al. | |
| 2014/0377516 | A1 | 12/2014 | Toda et al. | |
| 2015/0017396 | A1 | 1/2015 | Nakagawa et al. | |
| 2015/0050467 | A1 | 2/2015 | Nakagawa et al. | |
| 2015/0077479 | A1 | 3/2015 | Nakagawa et al. | |
| 2015/0077482 | A1 | 3/2015 | Toda et al. | |
| 2015/0116433 | A1 | 4/2015 | Fujii et al. | |
| 2015/0138284 | A1 | 5/2015 | Nagashima et al. | |
| 2015/0165787 | A1 | 6/2015 | Fujii et al. | |
| 2015/0191614 | A1 | 7/2015 | Nagashima et al. | |
| 2015/0258783 | A1 | 9/2015 | Toda et al. | |

(Continued)

FOREIGN PATENT DOCUMENTS

| | | |
|---|---|---|
| JP | 2005-074656 | 3/2005 |
| JP | 2010-142965 | 7/2010 |

(Continued)

*Primary Examiner* — Bradley W Thies
(74) *Attorney, Agent, or Firm* — Grüneberg and Myers PLLC

(57) ABSTRACT

A method of printing includes applying a processing fluid to a substrate and inkjet discharging a white ink to the substrate onto which the processing fluid has been applied, wherein the processing fluid contains a tri-valent metal salt, a non-ionic urethane resin, and water and the white ink contains a white pigment, a resin, and water.

20 Claims, 1 Drawing Sheet

(56) References Cited

U.S. PATENT DOCUMENTS

| | | | |
|---|---|---|---|
| 2015/0259553 | A1 | 9/2015 | Nakagawa et al. |
| 2015/0329731 | A1 | 11/2015 | Fujii et al. |
| 2015/0361282 | A1 | 12/2015 | Nakagawa et al. |
| 2015/0368492 | A1 | 12/2015 | Fujii et al. |
| 2016/0032122 | A1 | 2/2016 | Toda et al. |
| 2016/0068697 | A1 | 3/2016 | Toda et al. |
| 2016/0272834 | A1 | 9/2016 | Kobayashi et al. |
| 2016/0347962 | A1 | 12/2016 | Okada et al. |
| 2016/0355695 | A1 | 12/2016 | Nakagawa et al. |
| 2017/0022380 | A1 | 1/2017 | Nakagawa et al. |
| 2017/0051170 | A1 | 2/2017 | Nakagawa et al. |
| 2017/0107389 | A1 | 4/2017 | Umemura et al. |
| 2017/0121545 | A1 | 5/2017 | Nagashima et al. |
| 2017/0247561 | A1 | 8/2017 | Nakagawa et al. |
| 2019/0092956 | A1 | 3/2019 | Imanaga et al. |
| 2019/0168516 | A1 | 6/2019 | Nakagawa et al. |
| 2019/0284421 | A1 | 9/2019 | Sekiguchi et al. |
| 2019/0389231 | A1 | 12/2019 | Kaji et al. |
| 2020/0002558 | A1 | 1/2020 | Iwasaki et al. |
| 2020/0095444 | A1 | 3/2020 | Hagiwara et al. |
| 2020/0157366 | A1 | 5/2020 | Gotou et al. |
| 2020/0262228 | A1 | 8/2020 | Hagiwara et al. |
| 2020/0385592 | A1 | 12/2020 | Nakagawa et al. |
| 2020/0399496 | A1 | 12/2020 | Nonaka et al. |
| 2021/0292578 | A1 | 9/2021 | Nakagawa et al. |

FOREIGN PATENT DOCUMENTS

| | | |
|---|---|---|
| JP | 2015-048364 | 3/2015 |
| JP | 2018-094902 | 6/2018 |

* cited by examiner

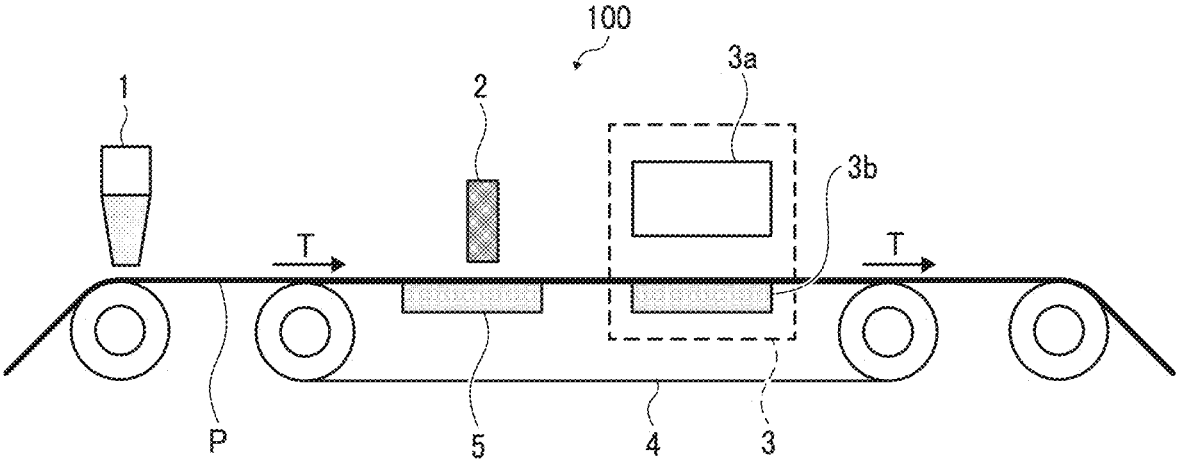
100
1
2
3a
3b
T
T
P
5
4
3

METHOD OF PRINTING INCLUDING APPLYING A PROCESSING FLUID AND WHITE INK TO A SUBSTRATE AND DEVICE FOR SUCH PRINTING

CROSS-REFERENCE TO RELATED APPLICATIONS

This patent application is based on and claims priority pursuant to 35 U.S.C. § 119 to Japanese Patent Application Nos. 2020-176153 and 2021-094067, filed on Oct. 20, 2020 and Jun. 4, 2021, respectively, in the Japan Patent Office, the entire disclosures of which are hereby incorporated by reference herein.

BACKGROUND

Technical Field

The present disclosure relates to a method of printing and a device for printing.

Description of the Related Art

Paper materials such as corrugated boards, kraft paper or paper containers are used to pack everyday commodities. Although flexo printing has long been used for printing on these materials that are massively produced and consumed, inkjet printing is now appealing for high-mix low-volume production. It is quickly diffusing because this printing readily creates color images for low-volume production and enjoys low running cost. In addition, inkjet printing is attractive when printing on products in industrial as well as home and office settings.

Inks including solvent inks and UV inks are used in this inkjet printing. Aqueous inks which contain water as the main solvent are particularly preferable because they are safe and less burden on the environment. However, aqueous inks involve problems of the quality of images attributable to low permeability and poor drying property. When aqueous ink is used to create a solid image, the coloring material in the ink permeates the inside of a substrate together with water, resulting in poor coloring. When colored paper such as a corrugated board and kraft paper is used as a substrate, white ink is preliminarily applied to the substrate to form a backdrop, which enhances the saturation of a color image. However, the white ink fails to completely conceal the substrate so that the color of paper may be exposed.

In an attempt to solve this problem of a coloring material permeating the inside of a substrate, together with water, ink containing processing fluid for thickening the ink or aggregating the coloring material is preliminarily applied to a substrate to minimize the permeation of the coloring material and enhance coloring.

SUMMARY

According to embodiments of the present disclosure, a method of printing is provided which includes applying a processing fluid to a substrate and inkjet discharging a white ink to the substrate onto which the processing fluid has been applied, wherein the processing fluid contains a tri-valent metal salt, a nonionic urethane resin, and water and the white ink contains a white pigment, a resin, and water.

BRIEF DESCRIPTION OF THE DRAWING

Various other objects, features and attendant advantages of the present invention will be more fully appreciated as the same becomes better understood from the detailed description when considered in connection with the accompanying drawing in which like reference characters designate like corresponding parts throughout and wherein:

FIGURE is a diagram illustrating a perspective view of an example of a device for printing.

The accompanying drawing is intended to depict example embodiments of the present invention and should not be interpreted to limit the scope thereof. The accompanying drawing is not to be considered as drawn to scale unless explicitly noted.

DESCRIPTION OF THE EMBODIMENTS

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Moreover, image forming, recording, printing, modeling, etc., in the present disclosure represent the same meaning, unless otherwise specified.

Embodiments of the present invention are described in detail below with reference to accompanying drawing(s). In describing embodiments illustrated in the drawing(s), specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

According to the present disclosure, a method of printing is provided which enhances the concealing property of white ink to a substrate in a white image formed with the white ink, minimizes the occurrence of non-uniform image density, and achieves a high abrasion resistance.

Next, aspects of embodiments of the present disclosure are described.

Method of Printing

The method of printing of the present disclosure includes applying a processing fluid to a substrate and inkjet discharging white ink to the substrate onto which the processing fluid has been applied. The method of printing further includes optionally drying the substrate onto which the white ink has been discharged with heat.

Applying Processing Fluid

Processing fluid is applied to a substrate in the applying a processing fluid process. The processing fluid is a liquid composition that is applied to a substrate before printing (inkjet discharging). It can be applied to all or part of the substrate. When partially applied to a substrate, the processing fluid is preferably applied in advance to regions to which white ink is applied in the inkjet discharging.

The method of applying processing fluid is not particularly limited. It includes a method of applying by roller application and a method of applying by inkjetting. It is preferable to employ the latter. Processing fluid is discharged from multiple nozzles of an inkjet head to a substrate in the inkjetting method. As the inkjet head, an inkjet line head or serial inkjet head are employed. Inkjet line heads have nozzles disposed in a straight line along the direction crossing the conveyance direction of a substrate. They discharge liquid droplets from a fixed position to the substrate which is continuously conveyed along the conveyance direction. Serial inkjet heads are movable along the direction crossing the conveyance direction of a substrate. They discharge liquid droplets to the substrate while the inkjet heads incessantly move along the conveyance direction of the substrate. Inkjet line heads are preferable to achieve a better productivity. The discharging method using an inkjet head is not particularly limited. Two ways of discharging are continuous spraying and on-demand discharging. On-demand discharging includes a piezo method, thermal method, and electrostatic method. The piezo method is preferable in terms of discharging reliability.

When processing fluid is discharged by inkjetting in the applying process, the amount of a liquid droplet discharged from an inkjet head is preferably from 1 to 30 pL. The speed of a liquid droplet is preferably from 5 to 20 m/s when it is discharged from an inkjet head. The drive frequency and the resolution are preferably 1 kHz or more and 300 dpi or more, respectively, in the application.

The inkjet head here means a member having multiple nozzles which applies energy to liquid to discharged liquid droplets as described above. The inkjet head can be formed according to a known configuration, which includes, for example, a liquid chamber, a liquid resistance, a diaphragm, and a nozzle member. It is preferable to use at least silicone or nickel to make at least part of the configuration constituting an inkjet head. The nozzle diameter of an inkjet head is preferably from 30 μm or less and more preferably from 1 to 20 μm.

The amount of processing fluid applied to a substrate in the application of the processing fluid is preferably from 7.5 to 15.0 $mL/m^2$. An amount of 7.5 $mL/m^2$ or more enables an application of processing fluid on a substrate without a gap and enhances the concealing property and abrasion resistance of a white image formed with white ink. An amount of 15.0 $mL/m^2$ or less prevents an excessive application of processing fluid and minimizes occurrence of uneven image density and enhances the abrasion resistance of a white image formed with white ink.

Processing Fluid

The processing fluid used in the application process is described below. The processing fluid in the present disclosure is a liquid composition applied to a substrate before white ink is discharged. It contains a component for aggregating components contained in the white ink.

The processing fluid contains a tri-valent metal salt, a nonionic urethane resin, and water. The processing fluid may optionally furthermore contain an organic solvent, a surfactant, and other additives.

Tri-Valent Metal Salt

The tri-valent metal salt aggregates components such as a white pigment and resin contained in white ink when the white ink is brought into contact with processing fluid applied to a substrate. Since the metal salt prevents the white pigment contained in white ink from excessively permeating the inside of a substrate, white images formed with the white ink achieve good concealing property. Since the metal salt is contained in processing fluid, the metal salt is uniformly distributed on the substrate when applied to a substrate. It is thus possible to minimize the unevenness of the image density in a white image formed with the white ink. The metal salt sufficiently aggregates components because it is tri-valent, which leads to a good concealing property and an even image density of a white image.

The tri-valent metal salt is selected depending on the component in white ink to be aggregated. It includes salts of aluminum, iron, and chromium. Of these, aluminum salts are preferable to minimize uneven image density in a white image formed with white ink. Specific examples of the tri-valent metal salts include, but are not limited to, aluminum chloride, aluminum nitrate, aluminum lactide, aluminum sulfate, aluminum ammonium sulfate, aluminum potassium sulfate, iron (III) chloride, iron (II) chloride, and chromium nitrate.

The proportion of the tri-valent metal to the processing fluid is preferably 1.0 percent by mass or greater, more preferably from 1.0 to 20.0 percent by mass, furthermore preferably from 1.0 to 10.0 percent by mass, and particularly preferably from 1.0 to 5.0 percent by mass. A proportion of 1.0 percent by mass or greater enhances aggregation of white ink and the concealing property of a white image formed with white ink. A proportion of 20.0 percent by mass or less improves the strength and attachability of the film of processing fluid formed as a result of drying the processing fluid applied and enhances the image density and glossiness of a white image formed as a result of drying white ink applied onto the film of the processing fluid.

Nonionic Urethane Resin

Nonionic urethane resin can be dispersed in a form of particles in an aqueous medium not by charges but by steric repulsion. Nonionic urethane resin has a hydrophilic structural unit in the main or side chain of the resin. It preferably contains urethane resin having a structural unit of polyoxyethylene accounting for 0.1 percent by mass or more of the mass of the urethane resin. A nonionic urethane resin is stably dispersed in processing fluid co-present with a tri-valent metal salt by steric repulsion because of the hydrophilic structural unit such as polyoxyethylene. A urethane resin can be used without hindering aggregation attributable to a tri-valent metal salt, which makes it possible to strike a balance between the abrasion resistance of a white image enhanced by the urethane resin and the effect attributable to the presence of a tri-valent metal.

The proportion of the nonionic resin to a processing fluid is preferably from 0.5 to 30.0 percent by mass and more preferably from 5.0 to 20.0 percent by mass. A proportion of 0.5 percent by mass or more makes it evenly and sufficiently cover a substrate with processing fluid containing a nonionic urethane resin, which enhances the abrasion resistance of a white image. A proportion of 30.0 percent by mass or less enhances applicability of processing fluid.

The glass transition temperature of nonionic urethane resin is preferably from −40 to 40 degrees C. in a state of film. A glass transition temperature of −40 degrees C. or higher minimizes tackiness at the film portion of processing fluid, which enhances abrasion resistance. A glass transition temperature of 40 degrees C. or lower enhances attachability to a substrate because of softened nonionic urethane resin.

As described above, the nonionic urethane resin is preferably contained in a state of dispersion. In other words, nonionic urethane resin is preferably contained in processing fluid in a form of particles. The median particle diameter $D_{50}$ of nonionic urethane resin particles is preferably from 40 to 300 nm, more preferably from 60 to 200 nm, and furthermore preferably from 80 to 150 nm. A median particle diameter $D_{50}$ of 40 nm or more readily minimizes excessive thickening of processing fluid. A median particle diameter $D_{50}$ of 300 nm or less enhances transparency of processing fluid film.

Method of Manufacturing Nonionic Urethane Resin

One way of manufacturing nonionic urethane resin (hereinafter also referred to as urethane resin) is as follows.

First, a polymer polyol (A), a short-chain polyhydric alcohol (B), a polyhydric alcohol (C) having an anionic group, and a polyisocyanate (D) are allowed to react in the absence of a solvent or the presence of an organic solvent to manufacture an isocyanate-terminated urethane prepolymer.

Next, the anionic group in the isocyanate-terminated urethane prepolymer is optionally neutralized with a neutralizing agent, and thereafter a polyamine (E) is added to form a urea bond formed between the terminal isocyanate group and the polyamine (E) so that the crystalline urethane resin can be elongated or cross-linked. Water is added to disperse the elongated or cross-linked prepolymer. Thereafter, the organic solvent is optionally removed to obtain urethane resin.

Specific examples of the usable organic solvent during the reaction include, but are not limited to, ketones such as acetone and methylethyl ketone, ethers such as tetrahydrofuran and dioxane, acetic acid esters such as ethyl acetate and butylacetate, nitriles such as acetonitrile, and amides such as dimethyl formamide, N-methyl pyrrolidone, and 1-ethyl-2-pyrrolidone. These can be used alone or in combination.

The composition ratio of each material for use in the reaction is that [moles of (C)/(moles of (A)+moles of (B)+moles of (C))] is preferably from 0.15 to 0.5, more preferably from 0.2 to 0.5, and furthermore preferably from 0.25 to 0.4.

A composition ratio is 0.5 or less makes it possible to minimize the degradation of water resistance of a white image attributable to excessive hydrophilicity. Further, the white ink can be prevented from being thickened caused by excessive miniaturization of the resin particles. Conversely, when the composition ratio is 0.15 or more, the dispersion stability of resin particles is improved.

The composition ratio of each material for use in the reaction is that [equivalent number of (D)/(equivalent number of (A)+equivalent number of (B)+equivalent number of (C))] is preferably from 1.05 to 1.6, more preferably from 1.05 to 1.5, and furthermore preferably from 1.1 to 1.25.

When the composition ratio is in this range, it is possible to create a white image with excellent mechanical strength so that the white image achieves excellent abrasion resistance.

Polymer Polyol (A)

The polymer polyol (A) is preferably a polycarbonate-based polymer polyol and more preferably an aliphatic-based polymer polyol. The polymer polyol can be used alone or in combination. Usable polymer polyols include polyether-based polymer polyols, polyester-based polymer polyols, and polycaprolactone-based polymer polyols.

The molecular weight of the polymer polyol is not particularly limited and can be suitably selected to suit to a particular application. In the GPC measurement, the weight average molecular weight (Mw) is preferably from 500 to 15,000, more preferably from 500 to 10,000, and furthermore preferably from 1,000 to 5.000.

Short-Chain Polyhydric Alcohol (B)

Specific examples of the short-chain polyhydric alcohol include, but are not limited to, polyhydric alcohols having 2 to 15 carbon atoms such as ethylene glycol, propylene glycol, 1,4-butanediol, 1,5-pentanediol, neopentyl glycol, 1,6-hexanediol, 1,8-octanediol, 1,4-cyclohexane dimethanol, diethylene glycol, glycerin, and trimethylolpropane.

Polyhydric Alcohol (C) Having Anionic Group

The polyhydric alcohol having an anionic group is not particularly limited. It is possible to use materials having two or more hydroxyl groups and a functional group such as carboxylic acid or sulfonic acid as the anionic group. Specific examples include, but are not limited to, carboxylic acid groups such as dimethylolpropionic acid, dimethylolbutanoic acid, dimethylolbutyric acid, dimethylolvaleric acid, trimethylolpropanoic acid, and trimethylolbutanoic acid and a sulfonic acid such as 1,4-butanediol-2-sulfonic acid.

Polyisocyanate (D)

Specific examples of the polyisocyanate include, but are not limited to, aromatic polyisocyante compounds such as 1,3-phenylene diisocyanate, 1,4-phenylene diisocyanate, 2,4-tolylene diisocyanate (TDI), 2,6-tolylene diisocyanate, 4,4'-diphenyl methane diisocyanate (MDI), 2,4-diphenyl methane diisocyanate, 4,4'-diisocynato biphenyl, 3,3'-dimethyl-4,4'-diisocyanate biphenyl, 3,3'-dimethyl-4,4'-diisocyanate diphenyl methane, 1,5-naphthylene diisocyanate, 4,4'4"-triphenyl methane triisocyanate, m-isocyanate phenyl sulphonyl isocyanate, and p-isocyanate phenyl sulfonyl isocyanate; aliphatic polyisocyanates compounds such as ethylene diisocyanate, tetramethylene diisocyanate, hexamethylene diisocyanate (HDI), dodecamethylene diisocyanate, 1,6,11-undecane triisocyanate, 2,2,4-trimethyl hexamethylene diisocyanate, lysine diisocyanate, 2,6-diisocyante methylcaproate, bis(2-isocyanate ethyl)fumarate, bis(2-isocyanateethyl)carbonate, and 2-isocyanate ethyl-2,6-diisocyanate hexanoate; and alicyclic polyisocyanate compounds such as isophorone diisocyante (IPDI), 4,4'-dicyclohexyl methane diisocyanate (hydrogenated MDI), cyclohexylene diisocyante, methylcyclohexylene diisocyanate (hydrogenated TDI), bis(2-isocyanateethyl)-4-dichlorohexene-1,2-dicarboxylate, 2,5-norbornane diisocyante, and 2,6-norbonane diisocyante. These can be used alone or in combination.

Of these, aliphatic polyisocyanate compounds and alicyclic polyisocyanate compounds are preferable. Alicyclic polyisocyanate compounds are more preferable and isophorone diisocyanate and 4,4'-dicyclohexylmethane diisocyanate are particularly preferable.

Polyanine (E)

Specific examples of the polyamine include, but are not limited to, diamines such as ethylene diamine, 1,2-propane diamine, 1,6-hexamethylene diamine, piperazine, 2,5-dimethyl piperazine, isophorone diamine, 4,4'-dicyclohexyl methane diamine, and 1,4-cyclohexane diamine, polyamines such as diethylene triamine, dipropylene triamine, and triethylene tetramine, hydrazines, hydrazines such as N,N'dimethyl hydrazine and 1,6-hexamethylene bis hydrazine, and dihydrazides such as succinic dihydrazide, adipic acid dihydrazide, glutaric acid dihydrazide, sebacic acid dihydrazide, and isophthalic acid dihydrazide.

Water

The proportion of water in processing fluid is not particularly limited and can be suitably selected to suit to a particular application. The proportion is preferably from 10.0 to 90.0 percent by mass and more preferably from 40.0 to 90.0 percent by mass of the mass of the processing fluid to enhance the drying property of the processing fluid.

Organic Solvent

The processing fluid may contain an organic solvent. The organic solvent is not particularly limited and water-soluble organic solvents can be used. It includes, but are not limited to, polyhydric alcohols, ethers such as polyhydric alcohol alkylethers and polyhydric alcohol arylethers, nitrogen-containing heterocyclic compounds, amides, amines, and sulfur-containing compounds.

Specific examples of polyolhydric alcohols include, but are not limited to, ethylene glycol, diethylene glycol, 1,2-propanediol, 1,3-propanediol, 1,2-butanediol, 1,3-butanediol, 1,4-butane diol, 2,3-butanediol, 3-methyl-1,3-butanediol, triethylene glycol, polyethylene glycol, polypropylene glycol, 1,2-pentanediol, 1,3-pentanediol, 1,4-pentanediol 2,4-pentanediol, 1,5-pentanediol, 1,2-hexanediol, 1,6-hexanediol, 1,3-hexanediol, 2,5-hexanediol, 1,5-hexanediol, glycerin, 1,2,6-hexanetriol, 2-ethyl-1,3-hexanediol, ethyl-1, 2,4-butanetriol, 1,2,3-butanetriol, 2,2,4-trimethyl-1,3-pentanediol, and petriol.

Specific examples of the polyhydric alcohol ethers include, but are not limited to, ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, and propylene glycol monoethyl ether.

Specific examples of the polyol aryl ethers include, but are not limited to, ethylene glycol monophenyl ether and ethylene glycol monobenzyl ether.

Specific examples of the nitrogen-containing heterocyclic compound include, but are not limited to, 2-pyrrolidone, N-methyl-2-pyrrolidone, N-hydroxyethyle-2-pyrrolidone, 1,3-dimethyl-2-imidazoline, s-caprolactam, and γ-butylolactone.

Specific examples of the amide include, but are not limited to, formamide, N-methylformamide, N,N-dimethylformamide, 3-methoxy-N,N-dimethyl propionamide, and 3-butoxy-N,N-dimethyl propionamide.

Specific examples of amines include, but are not limited to, monoethanolamine, diethanolamine, and triethylamine.

Specific examples of the sulfur-containing compounds include, but are not limited to, dimethyl sulphoxide, sulfolane, and thiodiethanol.

Specific examples of the other organic solvents include, but are not limited to, propylene carbonate and ethylene carbonate.

It is preferable to use an organic solvent having a boiling point of 250 or lower degrees C., which serves as a humectant and imparts a good drying property at the same time.

Polyol compounds having eight or more carbon atoms and glycol ether compounds are also suitably used as the organic solvent. Specific examples of the polyol compounds having eight or more carbon atoms include, but are not limited to, 2-ethyl-1,3-hexanediol and 2,2,4-trimethyl-1,3-pentanediol.

Specific examples of the glycolether compounds include, but are not limited to, polyhydric alcohol alkylethers such as ethylene glycol monoethylether, ethylene glycol monobutylether, diethylene glycol monomethylether, diethylene glycol monoethylether, diethylene glycol monobutylether, tetraethylene glycol monomethylether, and propylene glycol monoethylether and polyhydric alcohol arylethers such as ethylene glycol monophenylether and ethylene glycol monobenzylether.

The proportion of the organic solvent in processing fluid is not particularly limited and can be suitably selected to suit to a particular application. In terms of the drying property of processing liquid, the proportion is preferably from 1.0 to 60.0 percent by mass, more preferably from 3.0 to 30.0 percent by mass, and furthermore preferably from 5.0 to 20.0 percent by mass.

Surfactant

Examples of the surfactant include, but are not limited to, silicone-based surfactants, fluorochemical surfactants, amphoteric surfactants, nonionic surfactants, and anionic surfactants.

The silicone-based surfactant has no specific limit and can be suitably selected to suit to a particular application.

In particular, silicone-based surfactants which do not decompose even at a high pH are preferable.

Specific examples of the silicone-based surfactant include, but are not limited to, side-chain modified polydimethyl siloxane, both-terminal modified polydimethyl siloxane, one-terminal-modified polydimethyl siloxane, and side chain both-terminal modified polydimethyl siloxane. Silicone-based surfactants having a polyoxyethylene group or polyoxyethylene polyoxypropylene group as the modification group are particularly preferable because these demonstrate good properties as aqueous surfactants. It is possible to use a polyether-modified silicone-based surfactant as the silicone-based surfactant. A specific example is a compound in which a polyalkylene oxide structure is introduced into the side chain of the Si site of dimethyl silooxane.

Specific examples of the fluorochemical surfactant include, but are not limited to, perfluoroalkyl sulfonic acid compounds, perfluoroalkyl carboxylic acid compounds, ester compounds of perfluoroalkyl phosphoric acid, adducts of perfluoroalkyl ethylene oxide, and polyoxyalkylene ether polymer compounds having a perfluoroalkyl ether group in its side chain. These are particularly preferable because the fluorochemical surfactant does not readily produce foams.

Specific examples of the perfluoroalkyl sulfonic acid compounds include, but are not limited to, perfluoroalkyl sulfonic acid and salts of perfluoroalkyl sulfonic acid. Specific examples of the perfluoroalkyl carbonic acid compounds include, but are not limited to, perfluoroalkyl carbonic acid and salts of perfluoroalkyl carbonic acid.

Specific examples of the polyoxyalkylene ether polymer compounds having a perfluoroalkyl ether group in its side chain include, but are not limited to, sulfuric acid ester salts of polyoxyalkylene ether polymer having a perfluoroalkyl ether group in its side chain, and salts of polyoxyalkylene ether polymers having a perfluoroalkyl ether group in its side chain. Counter ions of salts in these fluorochemical surfactants are, for example, Li, Na, K, $NH_4$, $NH_3CH_2CH_2OH$, $NH_2(CH_2CH_2OH)_2$, and $NH(CH_2CH_2OH)_3$.

Specific examples of the amphoteric surfactants include, but are not limited to, lauryl aminopropionic acid salts, lauryl dimethyl betaine, stearyl dimethyl betaine, and lauryl dihydroxyethyl betaine.

Specific examples of the nonionic surfactants include, but are not limited to, polyoxyethylene alkyl phenyl ethers, polyoxyethylene alkyl esters, polyoxyethylene alkyl amines, polyoxyethylene alkyl amides, polyoxyethylene propylene block polymers, sorbitan aliphatic acid esters, polyoxyethylene sorbitan aliphatic acid esters, and adducts of acetylene alcohol with ethylene oxides.

Specific examples of the anionic surfactants include, but are not limited to, polyoxyethylene alkyl ether acetates, dodecyl benzene sulfonates, laurates, and polyoxyethylene alkyl ether sulfates.

These can be used alone or in combination.

The silicone-based surfactant has no particular limit and can be suitably selected to suit to a particular application.

Specific examples include, but are not limited to, side-chain-modified polydimethyl siloxane, both end-modified polydimethyl siloxane, one-end-modified polydimethyl siloxane, and side-chain-both-end-modified polydimethyl siloxane. In particular, a polyether-modified silicone-based surfactant having a polyoxyethylene group or a polyoxyethylene polyoxypropylene group is particularly preferable because such a surfactant demonstrates good property as an aqueous surfactant.

Such surfactants can be synthesized or procured. The products can be procured from BYK-Chemie GmbH, Shin-Etsu Silicone Co., Ltd., Dow Corning Toray Co., Ltd., NIHON EMULSION Co., Ltd., Kyoeisha Chemical Co., Ltd., and others.

The polyether-modified silicon-based surfactant has no particular limit and can be suitably selected to suit to a particular application. For example, a compound is usable in which the polyalkylene oxide structure represented by the following Chemical Formula S-1 is introduced into the side chain of the Si site of dimethyl polysiloxane.

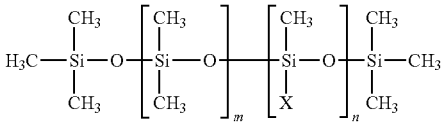

$X{=}{-}R(C_2H_4O)_a(C_3H_6O)_bR'$ Chemical Formula S-1

In Chemical Formula S-1, "m", "n", "a", and "b" each, respectively independently represent integers, R represents an alkylene group, and R' represents an alkyl group.

Specific examples of the polyether-modified silicone-based surfactant include, but are not limited to, KF-618, KF-642, and KF-643 (all manufactured by Shin-Etsu Chemical Co., Ltd.), EMALEX-SS-5602 and SS-1906EX (both manufactured by NIHON EMULSION Co., Ltd.), FZ-2105, FZ-2118, FZ-2154, FZ-2161, FZ-2162, FZ-2163, and FZ-2164 (all manufactured by Dow Corning Toray Co., Ltd.). BYK-33 and BYK-387 (both manufactured by BYK Chemie GmbH), and TSF4440, TSF4452, and TSF4453 (all manufactured by Momentive Performance Materials Inc.).

A compound in which the number of carbon atoms replaced with fluorine atoms is from 2 to 16 is preferable and, from 4 to 16, more preferable, as the fluorochemical surfactant.

Specific examples of the fluorochemical surfactant include, but are not limited to, perfluoroalkyl phosphoric acid ester compounds, adducts of perfluoroalkyl with ethylene oxide, and polyoxyalkylene ether polymer compounds having a perfluoroalkyl ether group in its side chain. Of these, polyoxyalkylene ether polymer compounds having a perfluoroalkyl ether group in its side chain are preferable because these do not easily foam and the fluorochemical surfactant represented by the following Chemical Formula F-1 or Chemical Formula F-2 is preferable.

$CF_3CF_2(CF_2CF_2)_m{-}CH_2CH_2O(CH_2CH_2O)_nH$ Chemical Formula F-1

In the compound represented by Chemical Formula F-1, "m" is preferably 0 or an integer of from 1 to 10 and "n" is preferably 0 or an integer of from 1 to 40.

$C_nF_{2n+1}{-}CH_2CH(OH)CH_2{-}O{-}(CH_2CH_2O)_n{-}Y$
Chemical Formula F-2

In the compound represented by the Chemical Formula F-2, Y represents H or $C_mF_{2m+1}$, where n represents an integer of from 1 to 6, or $CH_2CH(OH)CH_2{-}C_mF_{2m+}1$, where m represents an integer of from 4 to 6, or $C_pH_{2p+1}$, where p is an integer of from 1 to 19. n represents an integer of from 1 to 6. a represents an integer of from 4 to 14.

The fluorochemical surfactant is commercially available. Specific examples include, but are not limited to, SURFLON S-111, S-112, S-113, S-121, S-131, S-132, S-141, and S-145 (all manufactured by ASAHI GLASS CO., LTD.); FLUORAD FC-93, FC-95, FC-98, FC-129. FC-135, FC-170C, FC-430, and FC-431 (all manufactured by Sumitomo 3M Limited); MEGAFACE F-470, F-1405, and F-474 (all manufactured by DIC CORPORATION); ZONYL TBS, FSP, FSA, FSN-100, FSN, FSO-100, FSO, FS-300, UR, and Capstone™ FS-30, FS-31, FS-3100. FS-34, and FS-35 (all manufactured by The Chemours Company); FT-110, FT-250, FT-251. FT-400S. FT-150, and FT-400SW (all manufactured by NEOS COMPANY LIMITED); POLYFOX PF-136A. PF-156A, PF-151N, PF-154, and PF-159 (manufactured by OMNOVA SOLUTIONS INC.); and UNIDYNET™ DSN-403N (manufactured by DAIKIN INDUSTRIES, Ltd.). Of these, FS-3100, FS-34, and FS-300 of The Chemours Company, FT-110, FT-250, FT-251, FT-400S, FT-150, and FT-400SW of NEOS COMPANY LIMITED, POLYFOX PF-151N of OMNOVA SOLUTIONS INC., and UNIDYNE™ DSN-403N (manufactured by DAIKIN INDUSTRIES, Ltd.) are particularly preferable.

The proportion of the surfactant in processing fluid is not particularly limited and can be suitably selected to suit to a particular application. For example, the proportion is preferably from 0.001 to 5 percent by mass and more preferably from 0.05 to 5 percent by mass to achieve excellent wettability and discharging stability.

Other Additives

The processing fluid may optionally contain other additives such as a defoaming agent, preservative and fungicide, corrosion inhibitor, and pH regulator.

Printing Process

The printing process includes printing by inkjet discharging white ink to regions of a substrate onto which processing fluid has been applied. The white ink is a liquid composition that is to be applied after the application of the processing fluid to all or part of the regions of a substrate where the processing fluid has been applied. This application of white ink to regions of a substrate where processing fluid has been applied achieves excellent concealing properties of a white image formed with the white ink to the substrate, minimizes unevenness of density, and enhances abrasion resistance.

The white ink is applied by inkjetting to regions of a substrate where processing fluid has been applied. In inkjetting the white ink, it is discharged from multiple nozzles of an inkjet head to a substrate. As the inkjet head, a line or serial inkjet head can be employed. The former is preferable to the latter in order to improve the productivity. The discharging method using an inkjet head is not particularly limited. Two ways of discharging are continuous spraying and on-demand discharging. On-demand discharging includes a piezo method, thermal method, and electrostatic method. The piezo method is preferable in terms of discharging reliability.

When discharging white ink by inkjetting for printing, the amount of a liquid droplet discharged from an inkjet head is preferably from 1 to 30 pL. The speed of a liquid droplet is preferably from 5 to 20 m/s when it is discharged from an inkjet head. The drive frequency and the resolution are preferably 1 kHz or more and 300 dpi or more, respectively, in the inkjet discharging.

The inkjet head here means a member having multiple nozzles which applies energy to liquid to discharged liquid droplets as described above. The inkjet head can be formed according to a known configuration, which includes, for example, a liquid chamber, a liquid resistance, a diaphragm, and a nozzle member. It is preferable to use at least silicone or nickel to make at least part of the configuration constituting an inkjet head. The nozzle diameter of an inkjet head is preferably from 30 μm or less and more preferably from 1 to 20 μm.

It is allowed to heat a substrate in the printing process. The surface temperature of a substrate during printing is preferably from 40 to 70 degrees C. by heating before and during printing. A surface temperature of 40 degrees C. or higher enhances the drying property of film of processing fluid applied in the processing fluid application process and film of white ink applied in the inkjet discharging, thereby minimizing occurrence of uneven density. A surface temperature of 70 degrees C. or lower prevents occurrence of deficient discharging in an inkjet head disposed close to a heated substrate, which leads to prevention of uneven density.

The device for heating a substrate during printing or discharging white ink can be suitably selected among known devices to suit to a particular application. A device does not preferably cause air flow around an inkjet head. For example, a device for heating the printing surface of a substrate by radiant heat in no contact manner immediately before printing and a device for heating the surface opposite to the printing surface of a substrate by transfer heat in a contact manner immediately before and during printing are preferable. Specific examples of the device for heating include, but are not limited to, a roll heater, a drum heater, a heater of hot plate type, a heated wind drier, an infrared drier, and an ultraviolet drier. Of these, a heater of hot plate type is preferable. These devices can be built into a typical inkjet printer or can be mounted as external devices. These can be suitably used alone or in combination to suit to a particular application.

The temperature of such a device for heating a substrate during printing is preferably from 40 to 70 degrees C. A temperature of from 40 to 70 degrees C. makes the surface of a substrate during printing from 40 to 70 degrees C. The temperature of a device represents the surface temperature of a device for heating when the device heats a substrate in a contact manner and a temperature around the device when it heats a substrate in a non-contact manner.

White Ink

The white ink for use in the printing, inkjet discharging, is described. The white ink in the present disclosure is a liquid compound that is applied to regions of a substrate where processing fluid has been applied after the processing fluid is applied. The white ink contains a component that agglomerates when it is brought into contact with a component contained in the processing fluid. The component contained in the processing fluid is a tri-valent metal salt. The component that agglomerates when it is brought into contact with a component contained in the processing fluid is white pigment or resin. This white ink is preferable when a white image formed with the white ink has a Hunter's brightness of 60 or greater and more preferable when 70 or greater.

The white ink contains a white pigment, resin, and water. The white ink may optionally furthermore contain an organic solvent, a surfactant, and other additives. Descriptions about water, the organic solvent, surfactant, and other additives in the white ink are omitted because they are the same as those in the processing fluid.

White Pigment

The white pigment demonstrates white color and includes substances such as inorganic pigments, inorganic hollow particles, and resin hollow particles. Of these, inorganic pigments are preferable.

Specific examples of the inorganic pigment include, but are not limited to, titanium oxide, iron oxide, calcium carbonate, barium sulfate, and aluminum hydroxide. Of these, titanium oxide is preferable to achieve an excellent concealing property for a substrate by a white image formed with white ink.

The proportion of the white pigment is preferably from 0.1 to 20.0 percent by mass and more preferably from 1.0 to 15.0 percent by mass of the total content of white ink to enhance the image density, fixability, and discharging stability.

White ink can be obtained by dispersing a white pigment. Such dispersing methods include a method of introducing a hydrophilic functional group into a pigment for preparing a self-dispersible pigment, a method of coating the surface of a pigment with a resin followed by dispersion, and a method of using a dispersant for dispersing a pigment.

One way of introducing a hydrophilic functional group into a white pigment is to add a functional group such as sulfone group and carboxyl group to white pigment for dispersing the white pigment in water.

One way of dispersing a white pigment whose surface is coated with resin is to encapsulate white pigment in a microcapsule. This can be referred to as a resin-coated pigment. In this case, all the white pigments contained in white ink are not necessarily entirely coated with resin. Pigments never or partially coated with resin are allowed to be dispersed in the white ink.

One way of dispersing using a dispersant is to use a known dispersant represented by a surfactant having a small or large molecular weight.

It is possible to select an anionic surfactant, cationic surfactant, nonionic surfactant, amphoteric surfactant, or others in accordance with the type of a white pigment.

A nonionic surfactant (RT-100, manufactured by TAKEMOTO OIL & FAT CO., LTD.) and a formalin condensate of naphthalene sodium sulfonate are suitably used as the dispersant.

Those can be used alone or in combination.

Resin

The resin contained in white ink enhances abrasion resistance of white images. Examples of such resins include, but are not limited to, urethane resins, polyester resins, acrylic-based resins, vinyl acetate-based resins, styrene-based resins, butadiene-based resins, styrene-butadiene-based resins, vinyl chloride-based resins, acrylic-styrene-based resins, and acrylic-silicone-based resins. Of these, the resin is preferably at least one selected from the group consisting of acrylic resins, urethane resins, and polyester resins to achieve good abrasion resistance of a white image. It is possible to use any suitable synthetic resin or procure a product.

The resin is preferably in a form of resin particles dispersed in white ink.

The volume average particle diameter (mean volume diameter) of the resin particle is not particularly limited and can be suitably selected to suit to a particular application. The mean volume diameter is preferably from 10 to 1,000 nm, more preferably from 10 to 200 nm, and particularly preferably from 10 to 100 nm to achieve good fixability and image robustness. The mean volume diameter can be measured by using an instrument such as a particle size analyzer (Nanotrac Wave-UT151, manufactured by MicrotracBEL Corp.).

The proportion of the content of the resin is not particularly limited and can be suitably selected to suit to a particular application. It is preferably from 1.0 to 30.0 percent by mass and more preferably from 5.0 to 20.0 percent by mass of the total mass of the ink to secure fixability and storage stability of the ink.

Drying

In the drying process, a substrate onto which white ink has been discharged is dried by heating on a necessity basis. This drying enhances the drying property of the processing fluid and white applied to a substrate. The surface temperature of a substrate is preferably from 70 to 95 degreed C in the drying process. A surface temperature of 70 degrees C. or higher promotes attachment of the resin contained in white ink, which enhances the abrasion resistance of a white image. In addition, a surface temperature of 95 degrees C. or lower moderates the drying speed, which enhances the glossiness of a white image.

The device for drying a substrate in the drying process is selected from known devices to suit to a particular application.

Specific examples include, but are not limited to, a heated wind drier that blows heated wind to the printing surface of a substrate, a drum drier that heats a roller drum in contact with a substrate, a nichrome heater, a halogen heater, a ceramic heater, a carbon heater, and a hot plate type heater. These driers can be used in combination. Of these, a heated wind drier can readily adjust the level of drying by the amount of wind or temperatures and quickly dry the printing surface without touching a substrate. It is thus preferable to enhance productivity and the image quality.

The temperature of the device for drying a substrate onto which white ink has been applied is preferably from 70 to 95 degrees C. in the drying process. A temperature region of from 70 to 95 degrees C. makes the surface temperature of a substrate onto which white ink has been applied from 70 to 95 degrees C. during drying. The temperature of a device for drying represents the surface temperature of the device when the device heats a substrate onto which white ink has been applied in a contact manner. It means a temperature around the device when it heats a substrate onto which white ink has been applied in a non-contact manner.

Substrate

The substrate for use in the method of printing is not particularly limited

Specific examples include, but are not limited to, plain paper, gloss paper, special paper, cloth, film, transparent sheets, general printing paper, wall paper, flooring, concrete, and synthetic leather. It is preferably a liquid absorptive medium, in particular, a colored substrate having a luminosity (L*) of 50 or less.

Specific examples of such a colored substrate include, but are not limited to, kraft paper, corrugated board (liner board), and cardboard. Such a substrate having a high level of permeation and a luminosity (L*) of 50 or less has a problem of white ink failing to conceal the background color of the substrate because the white ink (pigment) excessively permeates the substrate. In an attempt to avoid this problem, a method has been proposed by which permeation of a coloring material into the inside of a substrate is minimized by applying processing fluid capable of thickening ink or aggregating the coloring material in ink onto the substrate in advance, thereby enhancing coloring property, concealing property. However, this method involves a problem of uneven image density in a white image formed with white ink. In addition, the use of the method degrades the abrasion resistance of a white image. It is thus preferable that the method of printing of the present disclosure be applied to a substrate having a high level of permeation and a luminosity (L*) of 50 or less to achieve a high level of concealing property to a substrate, even image density, and a high level of abrasion resistance. "Colored" means colors other than white, which includes cyan, magenta, yellow, black, and mixtures of those colors, Device for Printing The device for printing of the present disclosure includes an applying device for applying a processing fluid to a substrate and an inkjet discharging printing device for discharging white ink. The device for printing may furthermore optionally include a drying device for drying the substrate by heating onto which the white ink has been discharged. The inkjet discharging printing device preferably inkjet discharges white ink to a substrate being heated by a heating device.

The device for printing is described using an example with reference to FIGURE. FIGURE is a schematic diagram illustrating an example of the device for printing. The device for printing of the present disclosure is not limited to the configuration illustrated in FIGURE.

A device 100 for printing illustrated in FIGURE includes an applying device 1 (as an example of the applying device for processing fluid) for applying processing fluid to a substrate P, an inkjet discharging printing device 1 (as an example of the inkjet discharging printing device), a drying device 3 (as an example of the drying device) for drying the substrate P by heating onto which white ink has been discharged, and a conveyance belt 4 for conveying the substrate P in a conveyance direction T along the conveyance path.

The applying device 1 is connected with a processing fluid container that contains processing fluid. The applying device 1 applies the processing fluid supplied from the processing fluid container. The applying device 1 preferably applied the processing fluid to the printing surface of the substrate P by inkjetting.

The inkjet discharging printing device 2 is connected with a white ink container that contains white ink. The printing device 2 applies the white ink supplied from the white ink container. It discharges the white ink by inkjetting to the printing surface of the substrate P that is being heated by a heating device 5 from the opposite side of the printing surface.

The drying device 3 includes a non-contacting drying device 3*a* for drying the substrate P by heating from the printing surface side in a non-contact manner and a contacting drying device 3*b* for drying the substrate P by heating from the printing surface side in a contact manner.

The device 100 may furthermore optionally include one or more non-white ink printing devices for inkjet discharging non-white ink such as black ink, cyan ink, magenta ink, and yellow ink between the position where the printing device 2 is disposed on the conveyance path of the substrate P and the position where drying device 3 is disposed.

Having generally described preferred embodiments of this disclosure, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Next, the present disclosure is described in detail with reference to Examples but is not limited thereto.

Preparation of Liquid Resin Dispersion 1

A total of 62.1 g of N-methyl-2-pyrrolidone was added to a diisocyanate compound obtained by allowing to react 30.0 g of 1,6-hexane diol, 92.1 g of dicyclohexyl methane-4,4-diisocyanate, 126 g of 1,6-hexamethylene diisocyanulate, and 167.0 g of polyethylene glycol monomethyl ether having a molecular weight of 1,000 followed by heating at 90 degrees C. in a nitrogen atmosphere to allow reaction for two hours, thus obtaining a prepolymer. Next, 600.0 g of water in which 0.2 g of silicone-based defoaming agent (SE-21, manufactured by Wacker Chemie AG) was dissolved was added to 450 g of the prepolymer at 25 degrees C. during stirring to obtain an emulsion. The compound represented by the Chemical Structure 1, ethylene diamine, and adipic acid hydrazide of a small amount were added dropwise to the emulsion to obtain a liquid resin dispersion 1 of nonionic urethane resin.

$H_2N—C_3H_6—Si(—OC_2H_5)_3$ Chemical Structure 1

Preparation of Liquid Resin Dispersion 2

A procured nonionic urethane resin (SUPERFLEX® 210, manufactured by DKS Co., Ltd.) was used to obtain a liquid resin dispersion 2.

Preparation of Liquid Resin Dispersion 3

A procured nonionic urethane resin (SUPERFLEX® 420, manufactured by DKS Co., Ltd.) was used to obtain a liquid resin dispersion 3.

Preparation of Liquid Resin Dispersion 4

A mixture of 50.0 g of polycarbonate diol (T-5651, manufactured by Asahi Kasei Corporation), 3.1 g of 2,2,-bis(hydroxymethyl)propionic acid, 1.6 g of triethylamine, 44.0 g of acetone, 26.4 g of isophorone diisocyanate, and 0.01 g of tin (II) 2-ethylhexanoate was allowed to react at 80 degrees C. in a nitrogen atmosphere for four hours to obtain a prepolymer. Next, 150.2 g of water in which 0.2 g of silicone-based defoaming agent SE-21 (manufactured by Wacker Chemie AG) was dissolved was added to obtain an emulsion. A total of 2.3 g of diethylenetriamine was added followed by allowing to react for four hours. Acetone was removed from the obtained reaction product under a reduced pressure to obtain a liquid resin dispersion 4 of anionic urethane resin.

Preparation of Liquid Resin Dispersion 5

Procured ethylene-vinylacetate-vinylchloride resin (SUMIKAFLEX® 850HQ, manufactured by Sumika Chemtex Company, Limited) was used to obtain a liquid resin dispersion 5.

Preparation of Liquid Resin Dispersion 6

Procured styrene-butadiene resin (NALSTAR SR-130, manufactured by NIPPON A&L INC.) was used to obtain a liquid resin dispersion 6.

Example 1

Preparation of Processing Fluid

A total of 100 g of a liquid mixture containing 2.0 g of aluminum nitrate, 10.0 g of liquid resin dispersion 1 (as solid portion), 10.0 g of 1,2-propane diol, 1.0 g of EMULGEN LS-106 (manufactured by Kao Corporation), 0.1 g of Proxel LV (manufactured by AVECIA GROUP), and the balance of deionized water was stirred for one hour to obtain a liquid dispersion. Next, this liquid dispersion was filtered with a polyvinilydene fluoride membrane filter (manufactured by Sartorius Stedim Biotech GmbH) having an average pore diameter of 5.0 μm under pressure to remove coarse particles and dust, thereby preparing processing fluid.

Preparation of White Ink

A total of 25.0 g of titanium oxide (STR-100W, manufactured by Sakai Chemical Industry Co., Ltd.), 5.0 g of a pigment dispersant (TEGO Dispers 651, manufactured by Evonik Japan Co., Ltd.), and 70.0 g of water were mixed and dispersed for 60 minutes using a bead mill (Research Labo, manufactured by Shinmaru Enterprises Corporation) with 0.2 mm diameter zirconia beads at a filling ratio of 60 percent at 8 m/s to obtain a liquid dispersion of white pigment.

Next, a total of 100 g of a liquid mixture containing 40.0 g (amount of liquid dispersion) of liquid dispersion of white pigment, 25.0 g of SUPERFLEX® 130 (manufactured by DKS Co., Ltd.), 1.7 g of TAKELAC™ W-6110 (manufactured by Mitsui Chemicals. Inc.), 15.0 g of 1,2-propane diol, 2.0 g of 3-methoxy-3-methyl-1-butanol, 1.0 g of TEGO WET 270 (manufactured by EVONIK INDUSTRIES), 0.1 g of PROXEL LV (manufactured by AVECIA GROUP), and a balance of deionized water were stirred for one hour. This liquid dispersion was filtered with a polyvinilydene fluoride membrane filter (manufactured by Sartorius Stedim Biotech GmbH) having an average pore diameter of 5.0 μm under pressure to remove coarse particles and dust, thereby preparing white ink.

Preparation of Printed Matter

A printing device capable of applying processing fluid, printing, and drying in this order inline with a single path was filled with the prepared processing fluid and white ink.

First, the processing fluid was discharged and applied from an inkjet line head to a liner board (NPK liner TF, 170 $g/m^2$, manufactured by NIPPON PAPER INDUSTRIES CO., LTD.) as a substrate for brown corrugated board. The amount of the processing fluid attached was 10.0 $mL/m^2$.

Next, the white ink was discharged from a piezoelectric inkjet line head to the region of the substrate where the processing fluid had been applied to print a 5 cm×5 cm solid image and a 5 cm×20 cm solid image at 1,200 dpi. In this printing, the head gap was 2 mm and the amount of white ink attached was 1.0 $mL/m^2$. In the printing, the substrate was heated from the opposite to the printing surface by a heating device (hot plate heater, temperature of the heating device of 55 degrees C.). The temperature of the substrate was 50 degrees C. when the white ink was discharged.

Thereafter, the substrate was heated and dried for two minutes by a drying device (heated wind heater, temperature of the drying device of 80 degrees C., the wind speed of 10 m/s). The temperature of the substrate was 80 degrees C.

Examples 2 and 3

Printing of Examples 2 and 3 was conducted with the processing fluids and white inks prepared in the same manner as in Example 1 except that the liquid resin dispersions 2 and 3 were used respectively instead of the liquid resin dispersion 1.

Examples 4 and 5

Printing of Examples 4 and 5 was conducted with the processing fluids and white inks prepared in the same manner as in Example 1 except that the proportion or type of the organic solvent was changed to that shown in Table 1.

Example 6

Printing of Example 6 was conducted with the processing fluid and white ink prepared in the same manner as in Example 1 except that aluminum nitrate was changed to aluminum sulfate.

Example 7

Printing of Example 7 was conducted with the processing fluid and white ink prepared in the same manner as in Example 1 except that the aluminum nitrate was changed to iron (III) chloride hexahydrate.

Example 8

Printing of Example 8 was conducted with the processing fluid and white ink prepared in the same manner as in Example 1 except that the proportion of aluminum nitrate was changed to that shown in Table 1.

Examples 9 to 12

Printing of Examples 9 to 12 was conducted with the processing fluids and white inks prepared in the same manner as in Example 1 except that the amounts of the processing fluid attached were changed to those shown in Table 2.

Examples 13 to 16

Printing of Examples 13 to 16 was conducted with the processing fluids and white inks prepared in the same manner as in Example 1 except that the temperature of the substrate was changed to those shown in Table 2.

Comparative Example 1

Printing of Comparative Example 1 was conducted in the same manner as in Example 1 without applying processing fluid.

Comparative Example 2

Printing of Comparative Example 2 was conducted with the processing fluid and white ink prepared in the same manner as in Example 1 except that aluminum nitrate was changed to magnesium nitrate.

Comparative Example 3

Printing of Comparative Example 3 was conducted with the processing fluid and white ink prepared in the same manner as in Example 1 except that the aluminum nitride was changed to potassium nitrate.

Comparative Examples 4 to 6

Printing of Comparative Examples 4 to 6 was conducted with the processing fluids and white inks prepared in the same manner as in Example 1 except that the liquid resin dispersions 4 to 6 were used respectively instead of the liquid resin dispersion 1.

Comparative Example 7

Printing of Comparative Example 7 was conducted with the processing fluids and white inks prepared in the same manner as in Example 1 except that a bar coater having a linear diameter of 0.05 mm was used as the applying device for processing fluid instead of the inkjet head.

Each printed image was evaluated on evenness of image density, concealing property, and abrasion dispersion. The measuring results are shown in Tables 1 to 3.

Evaluation on Evenness of Image Density

The obtained 5 cm×5 cm images were visually checked to evaluate the evenness of image density according to the following criteria. The grade A means most excellent. The grade C and above are preferable.

Evaluation Criteria

A: Even image density

B: Minimally uneven image density, causing no problem

C: Slightly uneven image density

D: Significantly uneven image density

Evaluation on Concealing Property

The luminosity (L*) of each printed 5 cm×5 cm image was measured five times using a handy spectrometer (X-Rite eXact, manufactured by X-Rite Inc.). The concealing property of the white ink against the background was evaluated according to the following evaluation criteria. The grade A means most excellent. The grade C and above are preferable.

Evaluation Criteria

A: The average of the luminosity was 82 or greater

B: The average of the luminosity was from 80 to less than 82

B: The average of the luminosity was from 75 to less than 80

A: The average of the luminosity was 75 or less

Evaluation on Abrasion Resistance

The printed portion of each printed 5 cm×20 cm image was rubbed back and forth 50 times under a load of 9N using a clockmeter (clockmeter C-1, manufactured by DAIEI KAGAKU SEIKI MFG. co., ltd.). The rubbed portion was visually checked to evaluate the abrasion resistance of the portion according to the following criteria.

The grade A means most excellent. The grade C and above are preferable.

Evaluation Criteria

A: No scratch present

B: Scratch present but no peeled portion present

C: Background partially exposed

D: Background of the portion under load completely exposed when rubbed back and forth less than 50 times Evaluation results regarding the above-mentioned items are shown in Table 3.

TABLE 1

| | | Example | | | |
|---|---|---|---|---|---|
| | | 1 | 2 | 3 | 4 |
| Resin | Pigment dispersion 1 (solid mass) | 10.0 | | | 10.0 |
| | Liquid resin dispersion 2 (solid mass) | | 10.0 | | |
| | Liquid resin dispersion 3 (solid mass) | | | 10.0 | |
| | Liquid resin dispersion 4 (solid mass) | | | | |
| | Liquid resin dispersion 5 (solid mass) | | | | |
| | Liquid resin dispersion 6 (solid mass) | | | | |
| Metal salt | Aluminum nitrate | 2.0 | 2.0 | 2.0 | 2.0 |
| | Aluminum sulfate | | | | |
| | Iron (III) chloride hexahydrate | | | | |
| | Magnesium nitrate | | | | |
| | Potassium nitrate | | | | |
| Organic solvent | 1,2-Propane diol | 10.0 | 10.0 | 10.0 | 5.0 |
| | 1,2-Butane diol | | | | |
| Surfactant | EMULGEN LS-106 | 1.0 | 1.0 | 1.0 | 1.0 |
| Preservative | PROXEL LV | 0.1 | 0.1 | 0.1 | 0.1 |
| Water | Deionized water | Balance | Balance | Balance | Balance |
| Total (g) | | 100 | 100 | 100 | 100 |
| Printing condition | Amount of processing fluid attached (mL/m$^2$) | 10 | 10 | 10 | 10 |
| | Temperature of substrate (in printing) (degrees C.) | 50 | 50 | 50 | 50 |
| | Temperature of substrate in dying) (degrees C.) | 80 | 80 | 80 | 80 |
| Evaluation result | Uneveness of density | A | A | A | A |
| | Concealing properly | A | A | A | A |
| | Abrasion resistance | A | A | A | A |
| Resin | Pigment dispersion 1 (solid mass) | 10.0 | | | 10.0 |
| | Liquid resin dispersion 2 (solid mass) | | 10.0 | | |
| | Liquid resin dispersion 3 (solid mass) | | | 10.0 | |
| | Liquid resin dispersion 4 (solid mass) | | | | |
| | Liquid resin dispersion 5 (solid mass) | | | | |
| | Liquid resin dispersion 6 (solid mass) | | | | |
| Metal salt | Aluminum nitrite | 2.0 | 2.0 | 2.0 | 2.0 |
| | Aluminum sulfate | | | | |
| | Iron (III) chloride hexahydrate | | | | |
| | Magnesium nitrate | | | | |
| | Potassium nitrate | | | | |
| Organic solvent | 1,2-Propane diol | 10.0 | 10.0 | 10.0 | 5.0 |
| | 1,2-Butane diol | | | | |
| Surfactant | EMULGEN LS-106 | 1.0 | 1.0 | 1.0 | 1.0 |
| Preservative | PROXEL LV | 0.1 | 0.1 | 0.1 | 0.1 |
| Water | Deionized water | Balance | Balance | Balance | Balance |
| Total (g) | | 100 | 100 | 100 | 100 |
| Printing condition | Amount of processing fluid attached (mL/m$^2$) | 10 | 10 | 10 | 10 |
| | Temperature of substrate (in printing) (degrees C.) | 50 | 50 | 50 | 50 |
| | Temperature of substrate in dying) (degrees C.) | 80 | 80 | 80 | 80 |
| Evaluation result | Uneveness of density | A | A | A | A |
| | Concealing property | A | A | A | A |
| | Abrasion resistance | A | A | A | A |

| | | Example | | | |
|---|---|---|---|---|---|
| | | 5 | 6 | 7 | 8 |
| Resin | Pigment dispersion 1 (solid mass) | 10.0 | 10.0 | 10.0 | 10.0 |
| | Liquid resin dispersion 2 (solid mass) | | | | |
| | Liquid resin dispersion 3 (solid mass) | | | | |
| | Liquid resin dispersion 4 (solid mass) | | | | |
| | Liquid resin dispersion 5 (solid mass) | | | | |
| | Liquid resin dispersion 6 (solid mass) | | | | |
| Metal salt | Aluminum nitrate | 2.0 | | | 0.5 |
| | Aluminum sulfate | | 2.0 | | |
| | Iron (III) chloride hexahydrate | | | 2. 0 | |
| | Magnesium nitrate | | | | |
| | Potassium nitrate | | | | |

TABLE 1-continued

| | | | | | |
|---|---|---|---|---|---|
| Organic solvent | 1,2-Propane diol | | 10.0 | 10.0 | 10.0 |
| | 1,2-Butane diol | 10.0 | | | |
| Surfactant | EMULGEN LS-106 | 1.0 | 1.0 | 1.0 | 1.0 |
| Preservative | PROXEL LV | 0.1 | 0.1 | 0.1 | 0.1 |
| Water | Deionized water | Balance | Balance | Balance | Balance |
| Total (g) | | 100 | 100 | 100 | 100 |
| Printing condition | Amount of processing fluid attached (mL/m$^2$) | 10 | 10 | 10 | 10 |
| | Temperature of substrate in printing) (degrees C.) | 50 | 50 | 50 | 50 |
| | Temperature of substrate in dying) (degrees C.) | 80 | 80 | 80 | 80 |
| Evaluation result | Unevenness of density | A | A | B | A |
| | Concealing property | A | A | A | C |
| | Abrasion resistance | A | A | A | A |
| Resin | Pigment dispersion 1 (solid mass) | 10.0 | 10.0 | 10.0 | 10.0 |
| | Liquid resin dispersion 2 (solid mass) | | | | |
| | Liquid resin dispersion 3 (solid mass) | | | | |
| | Liquid resin dispersion 4 (solid mass) | | | | |
| | Liquid resin dispersion 5 (solid mass) | | | | |
| | Liquid resin dispersion 6 (solid mass) | | | | |
| Metal salt | Aluminum nitrate | 2.0 | | | 0.5 |
| | Aluminum sulfate | | 2.0 | | |
| | Iron (III) chloride hexahydrate | | | 2.0 | |
| | Magnesium nitrate | | | | |
| | Potassium nitrate | | | | |
| Organic solvent | 1,2-Propane diol | | 10.0 | 10.0 | 10.0 |
| | 1,2-Butane diol | 10.0 | | | |
| Surfactant | EMULGEN LS-106 | 1.0 | 1.0 | 1.0 | 1.0 |
| Preservative | PROXEL LV | 0.1 | 0.1 | 0.1 | 0.1 |
| Water | Deionized water | Balance | Balance | Balance | Balance |
| Total (g) | | 100 | 100 | 100 | 100 |
| Printing condition | Amount of processing fluid attached (mL/m$^2$) | 10 | 10 | 10 | 10 |
| | Temperature of substrate (in printing) (degrees C.) | 50 | 50 | 50 | 50 |
| | Temperature of substrate (in dying) (degrees C.) | 80 | 80 | 80 | 80 |
| Evaluation result | Unevenness of density | A | A | B | A |
| | Concealing property | A | A | A | C |
| | Abrasion resistance | A | A | A | A |

TABLE 2

| | | Example | | | |
|---|---|---|---|---|---|
| | | 9 | 10 | 11 | 12 |
| Resin | Liquid resin dispersion 1 (solid mass) | 10.0 | 10.0 | 10.0 | 10.0 |
| | Liquid resin dispersion 2 (solid mass) | | | | |
| | Liquid resin dispersion 3 (solid mass) | | | | |
| | Liquid resin dispersion 4 (solid mass) | | | | |
| | Liquid resin dispersion 5 (solid mass) | | | | |
| | Liquid resin dispersion 6 (solid mass) | | | | |
| Metal salt | Aluminum nitrate | 2.0 | 2.0 | 2.0 | 2.0 |
| | Aluminum sulfate | | | | |
| | Iron (III) chloride hexahydrate | | | | |
| | Magnesium nitrate | | | | |
| | Potassium nitrate | | | | |
| Organic solvent | 1,2-Propane diol | 10.0 | 10.0 | 10.0 | 10.0 |
| | 1,2-Butane diol | | | | |
| Surfactant | EMULGEN LS-106 | 1.0 | 1.0 | 1.0 | 1.0 |
| Preservative | PROXEL LV | 0.1 | 0.1 | 0.1 | 0.1 |
| Water | Deionized water | Balance | Balance | Balance | Balance |
| Total (g) | | 100 | 100 | 100 | 100 |
| Printing condition | Amount of processing fluid attached (mL/m$^2$) | 6 | 7.5 | 15 | 17.5 |
| | Temperature of substrate (in printing) (degrees C.) | 50 | 50 | 50 | 50 |
| | Temperature of substrate (in dying) (degrees C.) | 80 | 80 | 80 | 80 |

TABLE 2-continued

| | | | | | |
|---|---|---|---|---|---|
| Evaluation result | Unevenness of density | A | A | A | B |
| | Concealing property | B | A | A | A |
| | Abrasion resistance | B | A | A | B |

| | | Example | | | |
|---|---|---|---|---|---|
| | | 13 | 14 | 15 | 16 |
| Resin | Liquid resin dispersion 1 Solid mass) | 10.0 | 10.0 | 10.0 | 10.0 |
| | Liquid resin dispersion 2 (solid mass) | | | | |
| | Liquid resin dispersion 3 (solid mass) | | | | |
| | Liquid resin dispersion 4 Solid mass) | | | | |
| | Liquid resin dispersion 5 (solid mass) | | | | |
| | Liquid resin dispersion 6 (solid mass) | | | | |
| Metal salt | Aluminum nitrate | 2.0 | 2.0 | 2.0 | 2.0 |
| | Aluminum sulfate | | | | |
| | Iron (III) chloride hexahydrate | | | | |
| | Magnesium nitrate | | | | |
| | Potassium nitrate | | | | |
| Organic solvent | 1,2-Propane diol | 10.0 | 10.0 | 10.0 | 10.0 |
| | 1,2-Butane diol | | | | |
| Surfactant | EMULGEN LS-106 | 1.0 | 1.0 | 1.0 | 1.0 |
| Preservative | PROXEL LV | 0.1 | 0.1 | 0.1 | 0.1 |
| Water | Deionized water | Balance | Balance | Balance | Balance |
| Total (g) | | 100 | 100 | 100 | 100 |
| Printing condition | Amount of processing fluid attached ($mL/m^2$) | 10 | 10 | 10 | 10 |
| | Temperature of substrate in printing) (degrees C.) | 25 | 40 | 70 | 80 |
| | Temperature of substrate (in dying) (degrees C.) | 80 | 80 | 80 | 80 |
| Evaluation result | Unevenness of density | B | A | B | C |
| | Concealing property | A | A | A | A |
| | Abrasion resistance | B | B | A | A |

TABLE 3

| | | Comparative Example | | | |
|---|---|---|---|---|---|
| | | 1 | 2 | 3 | 4 |
| Resin | Liquid resin dispersion 1 (solid mass) | — | 10.0 | 10.0 | |
| | Liquid resin dispersion (solid mass) | | | | |
| | Liquid resin dispersion 3 (solid mass) | | | | |
| | Liquid resin dispersion 4 (solid mass | — | | | 10.0 |
| | Liquid resin dispersion 5 (solid mass) | — | | | |
| | Liquid resin dispersion 6 (solid mass) | — | | | |
| Metal salt | Aluminum nitrate | — | | | 2.0 |
| | Aluminum sulfate | — | | | |
| | Iron (III) chloride hexahydrate | — | | | |
| | Magnesium nitrate | — | 2.0 | | |
| | Potassium nitrate | — | | 2.0 | |
| Organic solvent | 1,2-Propane diol | — | 10.0 | 10.0 | 10.0 |
| | 1,2-Butane diol | — | | | |
| Surfactant | EMULGEN LS-106 | — | 1.0 | 1.0 | 1.0 |
| Preservative | PROXEL LV | — | 0.1 | 0.1 | 0.1 |
| Water | Deionized water | — | Balance | Balance | Balance |
| Total (g) | | — | 100 | 100 | 100 |
| Printing condition | Amount of processing fluid attached ($mL/m^2$) | — | 10 | 10 | 10 |
| | Temperature of substrate printing) (degrees C.) | 50 | 50 | 50 | 50 |
| | Temperature of substrate (in dying) (degrees C.) | 80 | 80 | 80 | 80 |
| Evaluation result | Unevenness of density | D | C | D | D |
| | Concealing property | D | D | D | D |
| | Abrasion resistance | A | A | A | C |

| | | Comparative Example | | |
|---|---|---|---|---|
| | | 5 | 6 | 7 |
| Resin | Liquid resin dispersion 1 (solid mass) | | | 10.0 |
| | Liquid resin dispersion (solid mass) | | | |
| | Liquid res dispersion 3 (solid mass) | | | |
| | Liquid resin dispersion 4 (solid mass) | | | |

TABLE 3-continued

| | | | | |
|---|---|---|---|---|
| | Liquid resin dispersion 5 (solid mass) | 10.0 | | |
| | Liquid resin dispersion 6 (solid mass) | | 10.0 | |
| Metal salt | Aluminum nitrate | 2.0 | 2.0 | 2.0 |
| | Aluminum sulfate | | | |
| | Iron (III) chloride hexahydrate | | | |
| | Magnesium nitrate | | | |
| | Potassium nitrate | | | |
| Organic solvent | 1,2-Propane diol | 10.0 | 10.0 | 10.0 |
| | 1,2-Butane diol | | | |
| Surfactant | EMULGEN LS-106 | 1.0 | 1.0 | 1.0 |
| Preservative | PROXEL LV | 0.1 | 0.1 | 0.1 |
| Water | Deionized water | Balance | Balance | Balance |
| Total (g) | | 100 | 100 | 100 |
| Printing condition | Amount of processing fluid attached ($mL/m^2$) | 10 | 10 | — |
| | Temperature of substrate (in printing) (degrees C.) | 50 | 50 | 50 |
| | Temperature of substrate (in dying) (degrees C.) | 80 | 80 | 80 |
| Evaluation result | Unevenness of density | A | A | D |
| | Concealing property | A | A | B |
| | Abrasion resistance | D | D | A |

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A method of printing comprising:

applying an aqueous processing fluid to a substrate; and inkjet discharging an aqueous white ink onto the substrate to which the processing fluid has been applied;

wherein the processing fluid comprises a tri-valent metal salt, a nonionic urethane resin, and water, wherein the processing fluid contains from 10.0 to 90.0 percent by mass of water, and wherein the white ink comprises a white pigment, a resin, and water.

2. The method according to claim 1, wherein the tri-valent metal salt comprises an aluminum salt.

3. The method according to claim 1, wherein a proportion of the tri-valent metal salt to the processing fluid is from 1.0 percent by mass or more.

4. The method according to claim 1, wherein, in the applying, an amount of the processing fluid applied to the substrate is from 7.5 to 15.0 $mL/m^2$.

5. The method according to claim 1, wherein a temperature of the substrate in the inkjet discharging is from 40 to 70 degrees C.

6. The method according to claim 1, further comprising:

drying the substrate onto which the white ink has been discharged with heat, wherein a temperature of the substrate in the drying is from 70 to 95 degrees C.

7. The method according to claim 1, wherein a proportion of the water in the white ink is from 40.0 to 90.0 percent by mass.

8. The method according to claim 1, wherein both an applying device of the processing fluid in the applying and a discharging device of the white ink in the inkjet discharging are inkjet line heads.

9. The method according to claim 1, wherein the substrate comprises a liquid absorptive medium.

10. The method according to claim 1, wherein the substrate comprises colored kraft paper or corrugated board each having a luminosity (L*) of 50 or less.

11. The method according to claim 1, wherein the processing fluid contains from 40.0 to 90.0 percent by mass of water.

12. The method according to claim 1, wherein the processing fluid is free of organic solvent.

13. The method according to claim 1, wherein the processing fluid contains 3.0 to 30.0 percent by mass of organic solvent.

14. The method according to claim 1, wherein the processing fluid contains 5.0 to 20.0 percent by mass of organic solvent.

15. The method according to claim 14, wherein the metal salt is aluminum nitrate, aluminum sulfate, or iron MD chloride hexahydrate, and the organic solvent is 1,2-propane diol or 1,2-butane diol.

16. A device for printing comprising:

an applying device configured to apply an aqueous a processing fluid to a substrate; and an inkjet discharging printing device configured to inkjet discharge an aqueous white ink to the substrate onto which the processing fluid has been applied;

wherein the processing fluid comprises a tri-valent metal salt, a nonionic urethane resin, and water, wherein the processing fluid contains from 10.0 to 90.0 percent by mass of water, and wherein the white ink comprises a white pigment, a resin, and water.

17. The device according to claim 16, wherein the inkjet discharging printing device is configured to inkjet discharge the white ink to the substrate being heated by a heating device.

18. The device according to claim 17, wherein a temperature of the heating device is from 40 to 70 degrees C.

19. The device according to claim 16, further comprising:

a drying device configured to heat the substrate onto which the white ink has been discharged.

20. The device according to claim 19, wherein a temperature of the drying device is from 70 to 95 degrees C.

* * * * *